US005857918A

United States Patent [19]

Beene

[11] Patent Number: 5,857,918

[45] Date of Patent: Jan. 12, 1999

[54] BUMPER SYSTEM FOR A BOWLING ALLEY

[75] Inventor: Bobby R. Beene, Dallas, Tex.

[73] Assignee: AMF Bowling, Inc., Mechanicsville, Va.

[21] Appl. No.: 903,007

[22] Filed: Jul. 30, 1997

[51] Int. Cl.[6] ..... A63D 5/00

[52] U.S. Cl. ..... 473/55; 473/113

[58] Field of Search ..... 473/55, 106, 109, 473/113, 116

[56] References Cited

U.S. PATENT DOCUMENTS

| | | | |
|---|---|---|---|
| Re. 35,232 | 5/1996 | Stephens | 473/55 |
| 3,401,933 | 9/1968 | Conklin et al. | 473/113 |
| 4,900,024 | 2/1990 | Chandler et al. | 273/37 |
| 5,322,476 | 6/1994 | Wortman | 473/113 |
| 5,415,591 | 5/1995 | Beene | 473/113 |
| 5,417,616 | 5/1995 | Widrick | 473/113 |
| 5,681,224 | 10/1997 | Higashi | 473/109 |

*Primary Examiner*—William M. Pierce
*Attorney, Agent, or Firm*—Dougherty & Troxell

[57] ABSTRACT

A bowling alley bumper system which can be used for conventional bowling and for bumper bowling includes a bumper on each side of the alley. These bumpers are movable between an extended positioned to prevent a bowling ball from falling into a gutter and a retracted position for ordinary bowling. The system also includes a plurality of air cylinders and an electrical actuator for moving the bumpers between the two positions. In a preferred embodiment of the invention, a computer which is included in an automatic scorer, automatically raises and lowers the bumpers before and after an individual bowler who elects bumper bowling and at the same time elects to bowl with regular bowlers.

5 Claims, 8 Drawing Sheets

BUMPER SYSTEM FOR A BOWLING ALLEY

FIELD OF THE INVENTION

This invention relates to a bowling alley bumper system and more particularly to a semiautomatic and/or fully automated systems for moving the bumpers into an extended or retracted position.

BACKGROUND FOR THE INVENTION

Bowling alley bumper systems are designed to be used by children and/or the physically handicapped as well as others who lack the physical coordination or strength to bowl i.e., project a majority of balls over the length of the alley without the ball falling into one of the gutters. Early systems required relatively difficult steps to set up a lane or lanes for so-called bumper bowling. For this reason, a number of bowling alley operating personnel were reluctant to promote bumper bowling or to encourage children or the handicapped to use the lanes.

One approach to overcome the aforementioned problem is disclosed by Chandler et al. in U.S. Pat. No. 4,900,024. In such systems, an elongated bumper is mounted alongside and parallel to each alley gutter. The system also includes movable supports that permit the extension of the bumpers to guard the gutters when guarding is desired and retraction of the bumpers to expose the gutters when normal alley operation is desired. The Chandler et al. system extends upwardly above the level of the alley even in its recessed position. This presents an obstacle to walking between lanes and is considered unsightly by many ordinary bowlers.

More recent approaches to bumper bowling such as disclosed in the U.S. Pat. No. 5,181,716 of Stephens have contributed to the growing popularly of bumper bowling. As disclosed therein, a bowling alley bumper system includes a pair of gutters having longitudinally extending portions and an extending and retracting mechanism for moving those portions into an extended or retracted position. In the retracted position, bowling balls are free to fall into the gutter and the alley has the appearance of an ordinary alley. In one embodiment of that invention, the bumper portion of the gutter is moved up and down along an arc in an xz plane with little or no lateral movement. However, in such systems it is necessary for an individual to manually extend and or retract the bumpers using a special tool which is inserted into the bumper from the approach section of the alley.

In view of the growing popularity of bumper bowling, there is a demand for improved bowling alley bumper systems wherein the bumpers can be extended or retracted from a remote area. For example, a semiautomatic bumper bowling system allows a front desk operator in a bowling center to raise or lower the bumpers without leaving his/her desk. This eliminates the need for an individual to select a special tool, walk to a selected lane to raise the bumpers at the beginning of the game and then return to lower the bumpers when the game is over. In such systems it is also desirable to include a damping mechanism to reduce the mechanical shock and or noise when the bumpers are returned to their retracted position.

It is also believed that there may be a significant commercial demand for a fully automated system which is controlled by an automatic scoring system. Such systems would allow mixed bowling i.e., a bowling game wherein one or more bowlers elect to bowl with the bumpers extended while others elect to bowl with the bumpers in their retracted position. For example, in a bowling alley bumper system in accordance with one embodiment of the invention, a bowler enters their name at the beginning of the game and are given an option of bowling with/without bumpers. Then, assuming that bowler number 2 chooses to have the bumpers activated, the scoring system would automatically activate the bumpers up into their extended position when it is bowler number 2's turn to bowl. Then when bowler number 2 finishes their turn, and moves over to the next lane, the system will automatically lower the rails on the previously bowled lane and activate the bumpers on the next lane. This will then be repeated until the game is complete.

BRIEF SUMMARY OF THE INVENTION

In essence, the present invention contemplates a bowling alley bumper system which includes a semi-automatic and/or fully automated actuating system for moving the bumpers into an extended or retracted position. The system includes a support means such as a cement floor and/or a plurality of cross members and a bowling alley which is disposed on the support means. The bowling alley comprises an approach section, a pin deck and a longitudinally extending lane having a major axis and two sides disposed between the approach section and the pin deck and separated from the approach section by a foul line. The bowling alley also includes a pair of elongated concave gutters extending along and substantially abutting the sides of the lane between the ends thereof for receiving a bowling ball which falls off of the lane. Each of the gutters preferably include first and second longitudinally extending portions with each of the portions having a major axis which is parallel to the major axis of the lane. One of these portions of the gutters make up a longitudinally extending bumper section which is generally parallel to the major axis of the lane. The bowling alley bumper system in accordance with the present invention also includes extending and retracting means for moving the bumper segments upwardly with respect to the alley into a first or extended position to thereby prevent a bowling ball from falling into one of the gutters. The extending and retracting means is also effective for moving the bumper segments downwardly into a second or retracted position which allows bowling balls to roll into and along one of the gutters. A key element in the present invention, resides in the electro-mechanical means for moving the extending and retracting means between a first and a second position and remote actuating means for actuating the electrical means so that the bumper segments can be raised or lowered from a remote location, as for example, from a bowling center's manager's central location. Another feature of the present invention resides in the dampening means which allow the bumpers to return to the retracted position with minimal mechanical shock.

A preferred embodiment of the present invention also includes computer means and means for inputting a bowlers name and whether or not each bowler wants to use the bumper system. Means are also provided to raise or lower the bumper segments automatically in response to a signal from the computer means when it is the next bowler's turn to bowl. In this way, a young or inexperience bowler can bowl against more experience bowlers by bowling with the bumpers in an extended position while the more experience bowlers bowl with the bumpers in a retracted position. In addition, the young or inexperience bowler can do so without delaying the game to raise or lower the bumper.

DETAILED DESCRIPTION OF THE PREFERRED EMBODIMENTS OF THE INVENTION

Figure 1:
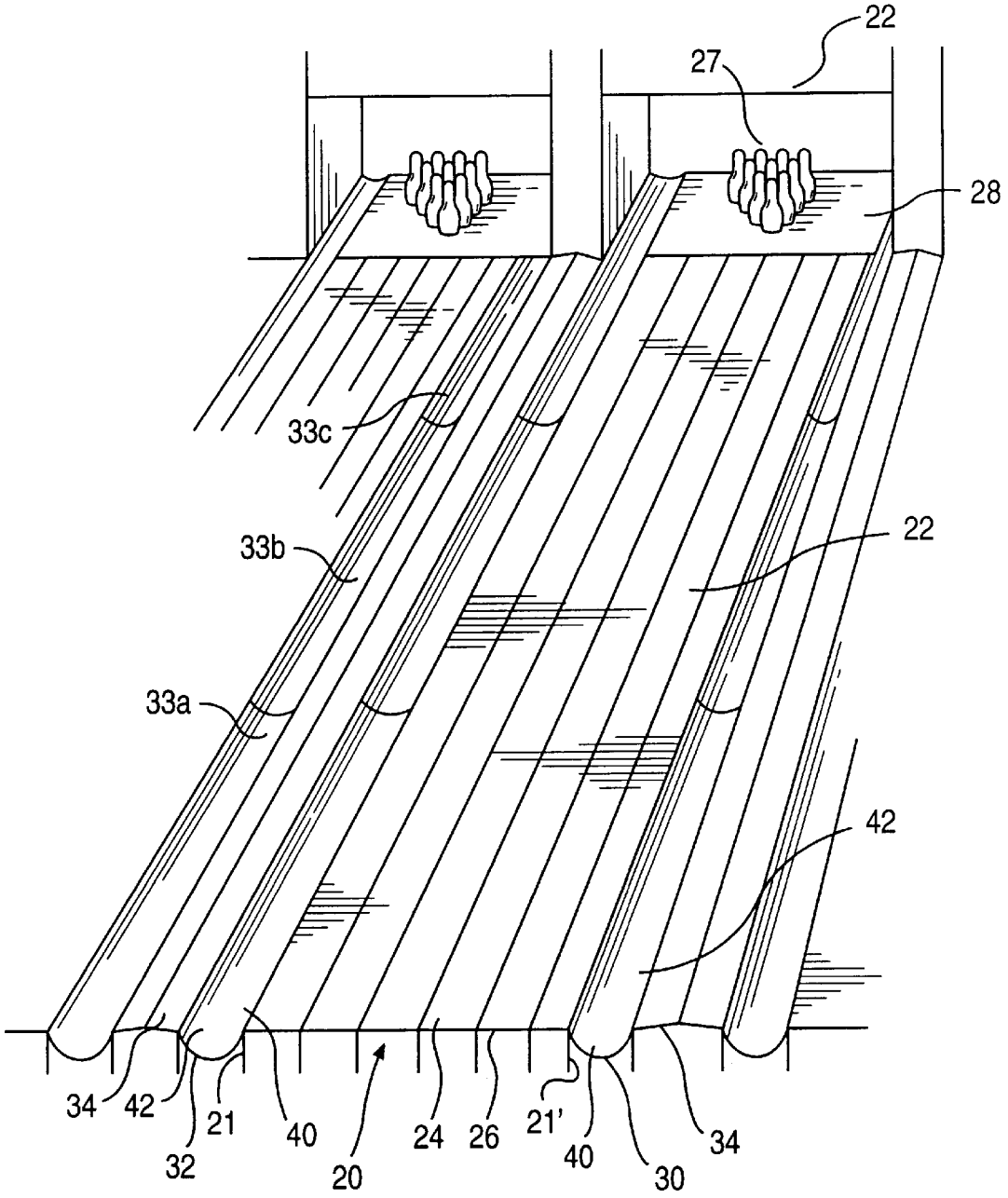
FIG. 1 is a perspective view of a bowling alley bumper system in accordance with one embodiment of the invention wherein the bumpers are shown in a retracted position.

The invention will now be described in connection with the accompanying drawings, wherein like reference numerals have been used to indicate like parts.

The invention has been described in connection with a Stephens type of bumper system as disclosed in the aforementioned U.S. Pat. No. 5,181,716 which is incorporated herein in its entirety by reference. While the preferred embodiment of the invention incorporates a Stephens type of apparatus, it should be recognized that the invention is also applicable to other types of bumper systems.

As illustrated in FIG. 1, a bowling alley 10 typically includes a longitudinally extending lane 20 which define a flat horizontal plane on an upper surface thereof and which is typically made up of a plurality of parallel abutting strips of wood 22 and 24. The alley includes a foul line 26 which extends across the lane 20 and which is perpendicular to the longitudinal axis of the lane. The foul line 26 indicates that area beyond which a bowler may not pass in releasing a bowling ball during a game of bowling. A pin deck 28 is disposed at the opposite end of the lane 20 and is adapted to receive a plurality of bowling pins 27 thereon. As shown, the bowling alley is set with the pins in a customary triangular pattern with one pin, the head pin in front, a second row of two pins, a third row with three pins and a final row of four pins.

A pair of longitudinally-extending gutters 30, 32 are disposed along the side of the lane 20 with one gutter on each side of lane 20 in a customary manner, i.e., adjacent to and in substantially abutting relationship with the lane. The gutters 30, 32 are adapted to receive any balls that are bowled toward one side of the lane and to direct any misdirected balls to the end of the alley. Also illustrated are capping members 34 which separate the adjacent alleys or lanes.

Figure 2:
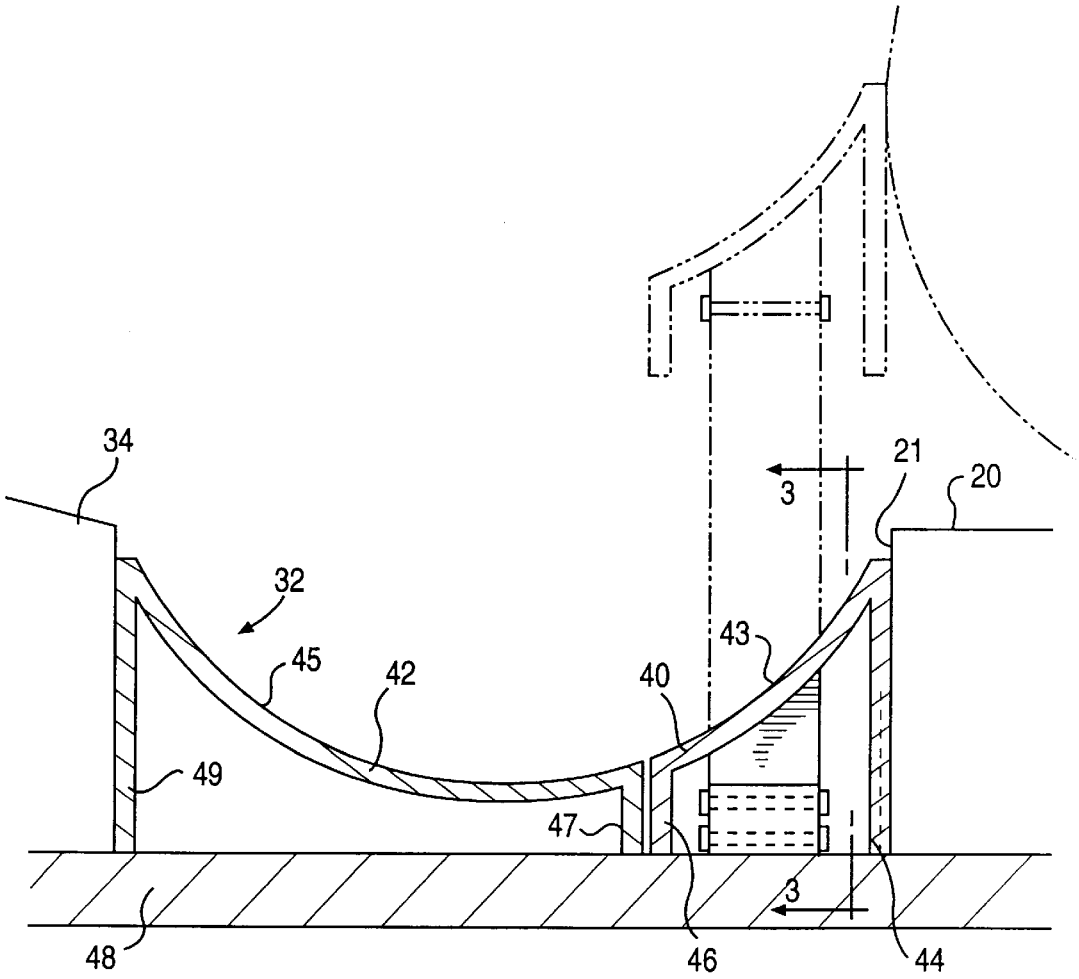
FIG. 2 is an end view of a portion of a bowling alley bumper system shown in FIG. 1, but with the bumper system shown in an extended position by broken lines.
Figure 3:
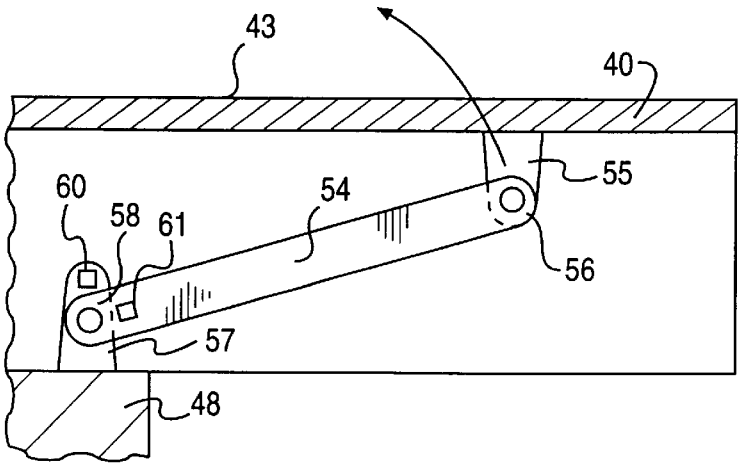
FIG. 3 is a cross-sectional view taken along 3—3 in FIG. 2.

The mechanism for bumper bowling is illustrated more clearly in FIGS. 2 and 3. As illustrated, a bumper bowling system is incorporated in the bowling alley 10 which includes two sides 21, 21' and a longitudinally extending lane 20 on an upper surface thereof. Each of the gutters 30, 32 define first and second concave longitudinally extending portions 40, 42. The first portion 40 defines an arc-shaped concave surface 43 which forms a part of the gutter 32, and as illustrated, forms about ⅓ of the gutter when viewed in cross section. The portion 40, may also include a pair of downwardly extending projections 44, 46 which are parallel to one is another. The projections 44, 46 support the portion 40 on a suitable base such as a plurality of cross members 48. The first projection 44 is adjacent to and abuts side 21 and is constructed and arranged to slide upwardly therealong as will be described hereinafter. The projection 44 may also include a resilient bumper 44' thereon for engaging a bowling ball which is directed toward the bumper. In a preferred embodiment of the invention, the bumpers are relatively small and considerably thinner than shown.

The second longitudinally extending portion 42 also defines an arc-shaped concave surface 45 which forms the outer portion of gutter 32. The portion 45 may also include a pair of downwardly extending parallel projections 47, 49. The projections 47, 49 are fixed to the cross member 48 in a customary manner with a first of the projections 47 adjacent to and perhaps abutting projection 46. The second projection 49 is adjacent to and abutting capping member 34 which separates a pair of alleys.

Figure 4:
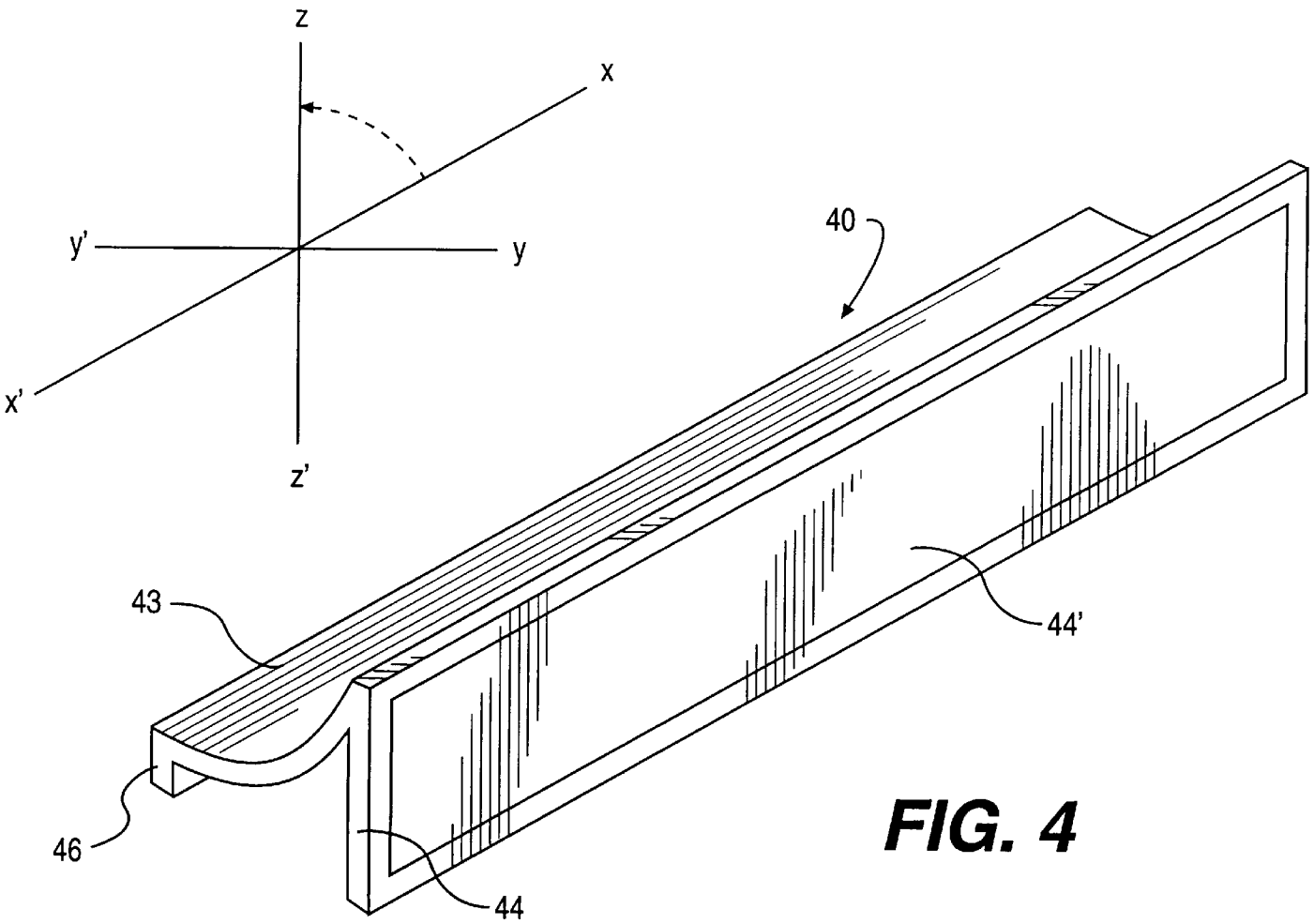
FIG. 4 is a perspective view of a portion of a bowling alley bumper which illustrates an arc-shaped movement within the xz plane in accordance with a preferred embodiment of the invention.

For conventional bowling, the longitudinally extending portions 40 are positioned in the lower or retracted position shown in FIGS. 1 and 2. However, when it is desired to convert the lane to bumper bowling as defined more clearly in the aforementioned patents of Conklin et al. and Chandler et al., each of which is incorporated herein in its entirety by reference, the portion 40 is raised upwardly along an arc as illustrated in FIGS. 3 and 4. The portion 40 is moved upwardly by means of a crank arm 54 and a pair of swivel connecting elements 56 and 58 to the position shown by the broken lines in FIG. 2. The swivel connecting elements 56 and 58 are operatively connected to the bottom of portion 40 in a conventional manner such as a bracket 55 and to the cross member 48 be means of a bracket 57. Locking means, such as projection 60 and detent 61 or other suitable mechanisms may also be provided for maintaining the bumper in an elevated position.

The portion 40 is moved upwardly along a path that corresponds to the arc shown in FIGS. 3 and 4. This motion is in the xz plane so that there is little or no lateral movement i.e., along the y axis as shown schematically in FIG. 4.

As illustrated, the gutters 30, 32 may be divided into three segments or more, 32 abc and 34 abc along the length of the alley for ease of manufacture, shipping and installation. However, in such cases, the mechanism for raising and lowering a portion of the gutter will be interconnected in a conventional manner so that a bumper may be raised along the length of the alley from one end of the alley.

Also, in moving the portion 40 along an arc in the xz plane, it may be desirable to bevel the forward edge thereof to avoid any binding during the elevating step.

Figure 5:
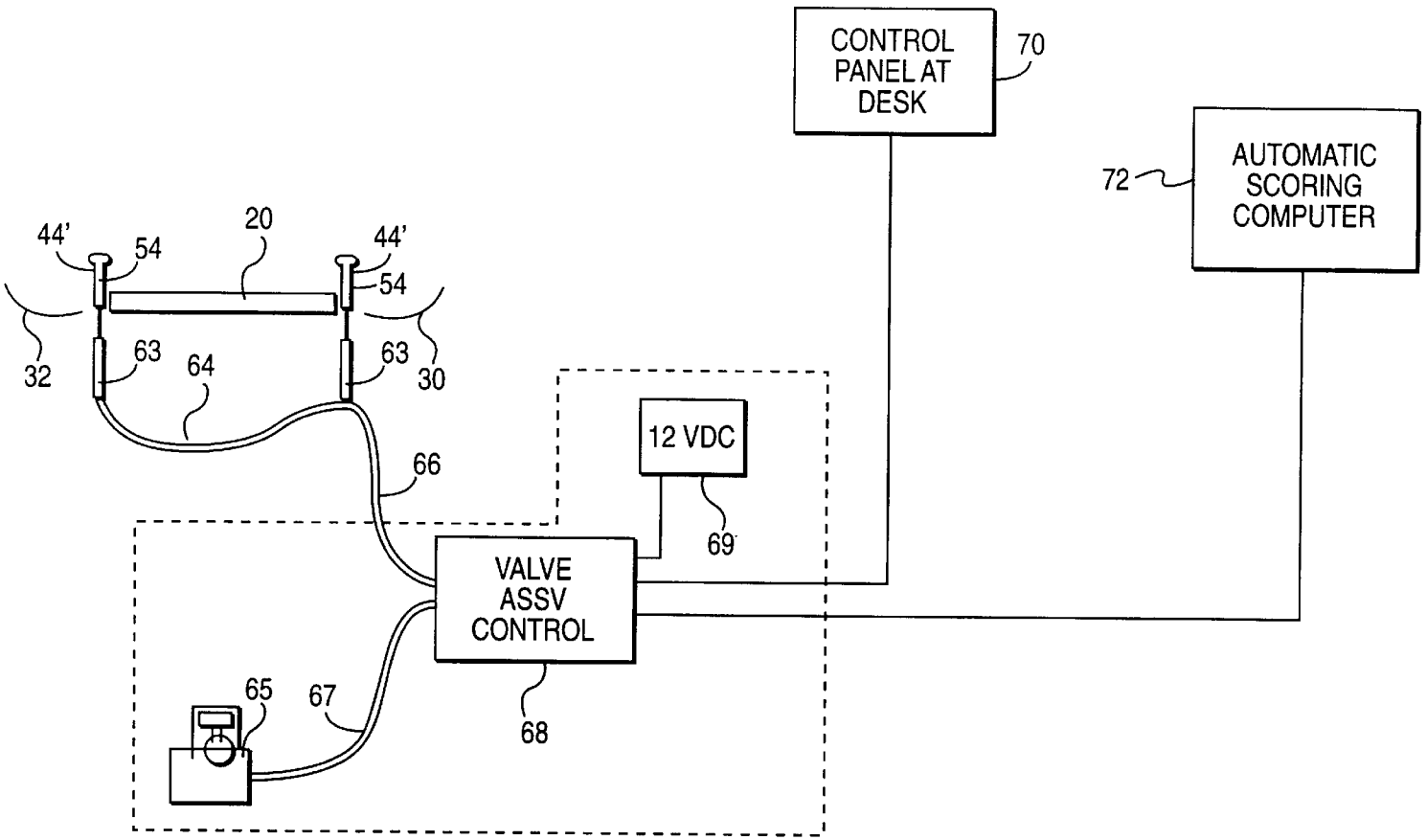
FIG. 5 is a schematic illustration of a bowling alley bumper system in accordance with a preferred embodiment of the present invention.

As illustrated in FIG. 5, a bowling alley bumper system in accordance with one preferred embodiment of the invention includes a semi-automatic and fully automated system for moving the bumpers into an extended or retracted position. For example, each of the bumpers 44' i.e., one bumper 44' is operatively connected to an air cylinder 63 by means of the crank arm 54 for raising and lowering the bumpers. While an air cylinder or plurality of air cylinders are used for raising or lowering the bumpers, it should be recognized that other electro-mechanical means such as an electric motor and gearing may be used in place thereof without departing from the scope of the invention.

In the preferred embodiment of the invention, the air cylinders 63 are connected to an air supply 65 or source of compressed air by means of pneumatic air lines 64, 66 and 67. The air cylinders 63 are connected to the air supply 65 through a valve assembly and control 68 wherein the operation of the valve and control is powered by a source of electric energy 69 such as a 12 volt power source. For the semi-automatic operation of the system, a bowling center manager or employee at a control panel 70 operates a simple on-off switch to raise or lower the bumpers 44'. In this mode of operation, the bumpers 44' are raised or lowered for an entire game wherein all of the bowlers elect bumper or regular bowling. Under such circumstances, the bowling alley employee sets the bumpers in a selected position for an entire game or games.

For a fully automated operation of the system, each bowler enters their name and their selection of bumper or regular bowling at a bowling console, i.e. into the automatic scoring computer 72 by means of a keyboard. The computer 72 then sends a signal to the valve assembly and control 68 to raise and lower the bumpers before and after each bowler who selects bumper bowling. The operation of the fully automatic mode will be described in more detail in connection with FIG. 9.

Figure 6:
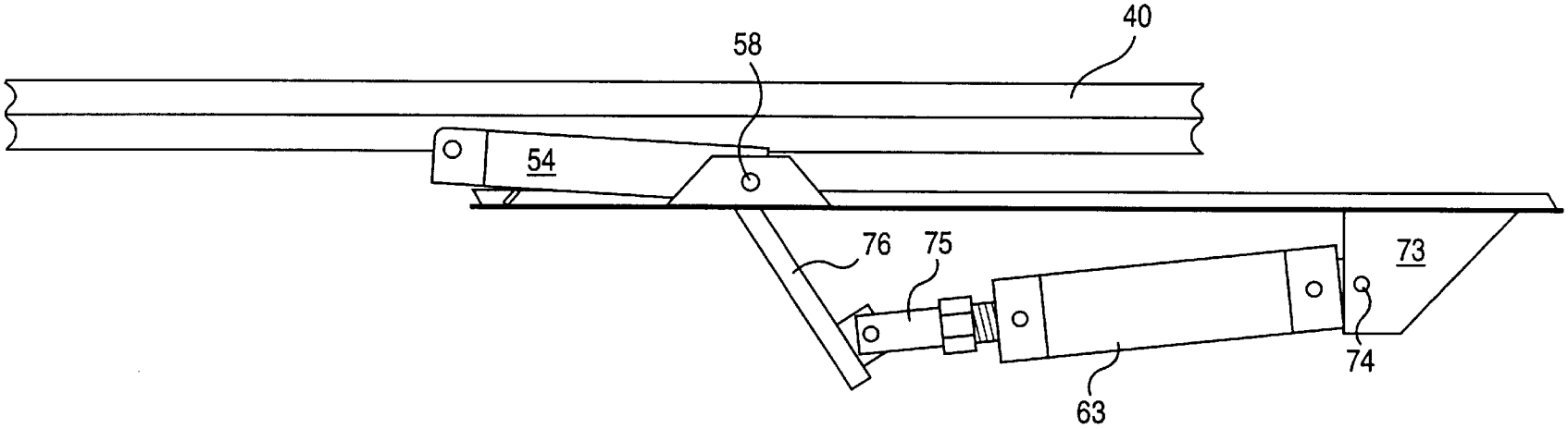
FIG. 6 is a side elevational view of the mechanism for raising and lowering the bumper with the bumper shown on their retracted position.
Figure 7:
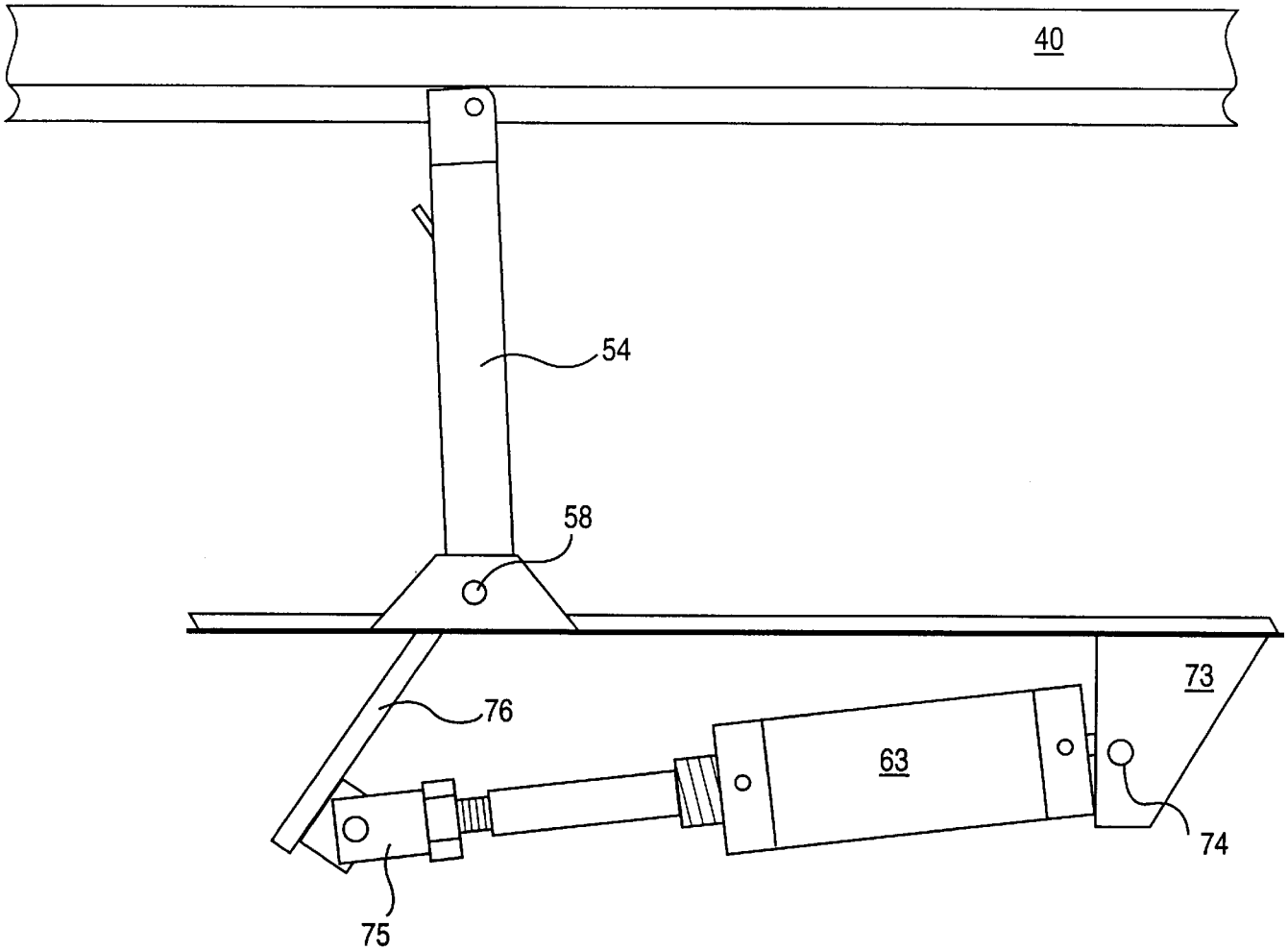
FIG. 7 is a side elevational view of the mechanism shown in FIG. 6, but with the bumper in its extended position.

FIGS. 6 and 7 illustrate the positioning of air cylinder 63 and the movement of the bumper 44' between their extended and retracted positions. As shown, the air cylinder 63 is fastened with respect to the bowling alley at one end thereof by a bracket 73. The cylinder 63 is connected to the bracket 73 by means of a suitable swivel joint 74 which permits limited rotation in a single plane as the air cylinder is extended and retracted. The opposite end of the air cylinder is connected by a shackle 75 to an actuating arm 76. Movement of the actuating arm 76 rotates the crank arm 54 about swivel 58 to move the portion 40 (bumper 44') from the retracted position shown in FIG. 6 to the extended position shown in FIG. 7.

As shown in FIG. 7, the crank arm 54 rotates though an angle of less than 90°, so that gravity assists the return of the bumper to its retracted position. It is therefore desirable to incorporate a fluid damping means in the air cylinder 63 to slow or cushion the return of the bumpers to their retracted position.

Figure 8:
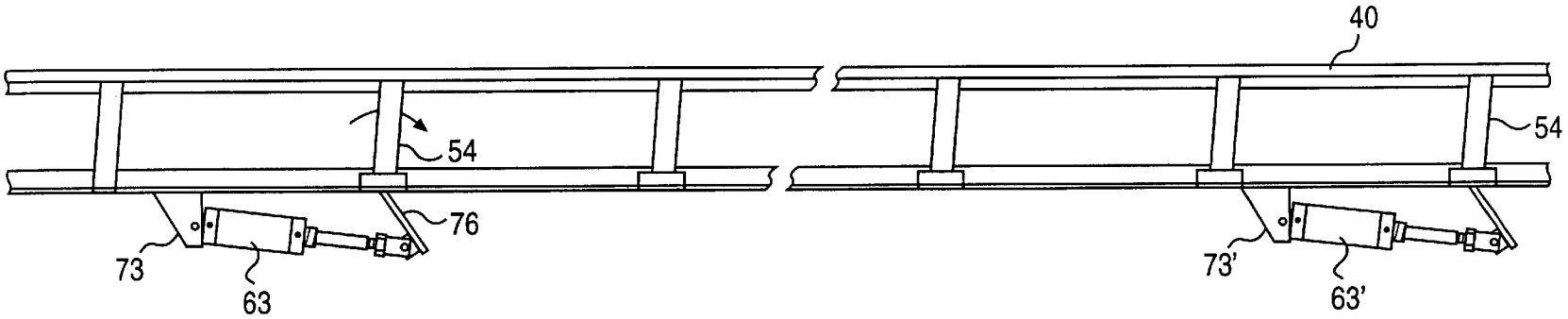
FIG. 8 is a side elevational view of the mechanism for raising and lowering a bumper in accordance with another embodiment of the invention.

A further embodiment of the invention is shown in FIG. 8. As illustrated therein, a second pneumatic or air cylinder 63' is connected to a bracket 73' at or near an opposite end of the bumper from the air cylinder 63. The use of two air cylinders on each side of an alley for raising and lowering the bumper is preferred. For example, it is presently believed that mounting the air cylinders about 15 feet from each end of the bumper offers optimal results for this type of installation.

In today's modern bowling centers, it is also customary to have automatic scores which detect the number of bowling pins knocked down by a bowler and to have apparatus that receives pin fall data signals and automatically computes the bowler's score according to the scoring rules of the American Bowling Congress. The bowling scoring apparatus at a pair of lanes is typically in a bowler's console that includes a data input means such as a keyboard to input bowlers names, handicaps, and to produce certain signals for control of pin setting and sensing equipment, the scoring apparatus and display means. Commonly, one bowler's console serves two adjacent lanes. The apparatus functions to keep track of a bowler's bowling lane as he bowls on one and the other in accordance with bowling league rules or it can function to accommodate non-league (open) bowling where a bowler bowls his entire game on one lane.

As examples of apparatus of the type described above, reference is made to the following U.S. Patents relating to the automatic scoring apparatus: U.S. Pat. Nos. 3,700,236; 4,092,727 and 4,302,010 each of which is incorporated herein in its entirety by reference. A more recent automatic scoring device is manufactured and sold by AMF Bowling, Inc. of Richmond, Va. under the AccuScore XL trademark.

A fully automated bumper system in accordance with the present invention typically includes a computer portion of an automatic scorer to generate signals to automatically raise and lower the bumpers for those bowlers in a game who select bumper bowling. The programming for the computer may take several forms, as will be well understood by a person of ordinary skill in the art of programming automatic scorers. However, FIG. 9 is a flow diagram which can be used in programming the computer for raising and lowering the bumpers automatically.

Figure 9:
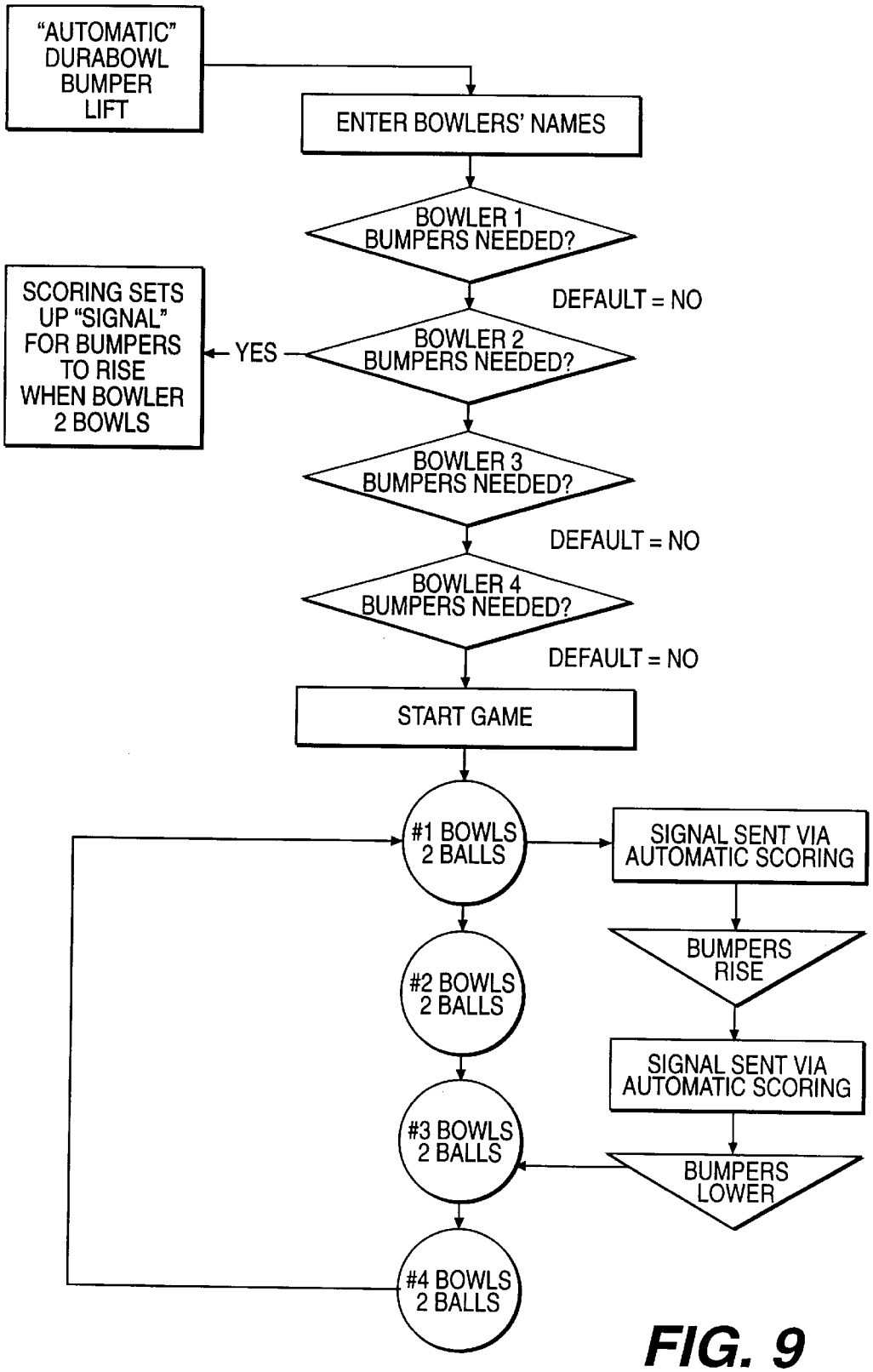
FIG. 9 is a flow chart which illustrates the functions of a computer program for use in a fully automated bumper system in accordance with the preferred embodiment of the invention.

As in conventional bowling, two or more bowlers use the data input means such as a keyboard at the bowler's console to input the bowlers names as shown at the top of FIG. 9. After entering a name or names each bowler is given the option to select bumper bowling. Assuming that the first bowler elects ordinary bowling, the system progresses to the next bowler i.e., bowler number 2. As illustrated, bowler number 2 elects bumper bowling which sends a signal to the automatic scorer to raise the bumpers when it is this bowler's turn to bowl and to lower the bumpers after the bowler's turn is up. As shown in FIG. 9, bowlers number 3 and 4 each elects regular bowling i.e., without bumpers.

After the last bowler enters his/her name and elects either bumper or regular bowling, the bowling console and/or display which is associated with the automatic scoring indicates the start of a game and that the first bowler is up in a conventional manner. Since the first bowler has elected regular bowling, no bumper raising signal is generated by the automatic scorer so that the bumpers remain in their recessed position. After the first bowler bowls two balls or a strike, the console or display indicates that the second bowler is up. At this point a signal is sent by the automatic scorer to raise the bumpers. Bowler number 2 then bowls two balls or a strike and a signal is sent via the automatic scorer to lower the bumpers.

The console or display then indicates it is bowler number 3's turn and subsequently bowler number 4's turn in a conventional manner. After bowler number 4 completes his/her turn, the program recycles back to bowler number 1 and repeats the process until ten frames have been bowled.

While the invention has been described in connection with its preferred embodiments, it should be understood that changes and modifications may be made without departing from the scope of the appended claims.

What is claimed is:

1. A bowling alley bumper system comprising support means and a bowling alley disposed on said support means, said bowling alley including a longitudinally extending lane having an upper surface and two laterally spaced sides with a major axis on the upper surface of said lane, said lane having a foul line at one end and a pin deck at the other end thereof, a pair of elongated concave gutters extending along and substantially abutting the sides of said lane between the ends thereof for receiving a bowling ball which falls off of said lane, each of said gutters including a longitudinally extending bumper having extending and retracting means including a rotatable crank arm for moving said bumpers upwardly with respect to said alley into an extended position to thereby prevent a bowling ball from falling into one of said gutters and downwardly into a retracted position which allows bowling balls to roll into and along said one of said gutters, means for limiting the rotation of said rotatable crank arm through an angle of less than 90° so that gravity assists the return of said bumpers to a retracted position, electromechanical means for moving said extending and retracting means to thereby move said bumpers from one of said positions to the other of said positions and remote actuating means for actuating said means for moving said extending and retracting means and damping means for damping the return of said bumpers to their retracted position.

2. A bowling alley bumper system according to claim 1 wherein said damping means comprises an air cylinder.

3. A bowling alley bumper system according to claim 1 in which said remote actuating means is a computer.

4. A bowling alley bumper system according to claim 3 in which said computer is part of an automatic scoring device.

5. A bowling alley bumper system according to claim 1 which includes means for one or more bowlers who are bowling together to select bumper bowling and which automatically raises or lowers the bumper before and after each such bowler that has selected bumper bowling.

* * * * *